US007802367B1

(12) United States Patent
Hocckelmann et al.

(10) Patent No.: US 7,802,367 B1
(45) Date of Patent: Sep. 28, 2010

(54) FENCE POST TOOL

(76) Inventors: Roger Hocckelmann, 535 Jordan Rd., Old Monroe, MO (US) 63369; Steve Vogelgesang, 2700 Eisenbath Rd., O'Fallon, MO (US) 63366

( * ) Notice: Subject to any disclaimer, the term of this patent is extended or adjusted under 35 U.S.C. 154(b) by 412 days.

(21) Appl. No.: 11/406,708

(22) Filed: Apr. 19, 2006

(51) Int. Cl.
*B26F 1/00* (2006.01)

(52) U.S. Cl. ..... 30/360; 30/358; 73/864.44; 83/188; 264/153

(58) Field of Classification Search ..... 30/360–363, 30/358; 83/686, 821, 683, 829, 685, 686.821, 83/188, 191; 264/153; 73/864.44; *B26F 1/00*
See application file for complete search history.

(56) References Cited

U.S. PATENT DOCUMENTS

| | | | | | |
|---|---|---|---|---|---|
| 1,817,223 | A | * | 8/1931 | Abramsom et al. | 30/360 |
| 2,221,904 | A | * | 11/1940 | Abrams et al. | 30/360 |
| 3,494,033 | A | | 2/1970 | Bosco et al. | |
| 3,683,499 | A | | 8/1972 | Robinson, Jr. | |
| 4,087,913 | A | * | 5/1978 | Jackson | 30/360 |
| 4,281,546 | A | * | 8/1981 | Fraleigh | 73/864.44 |
| 4,380,871 | A | | 4/1983 | Adleman | |
| 4,403,417 | A | * | 9/1983 | Wilson et al. | 30/360 |
| 4,481,700 | A | | 11/1984 | Redmon | |
| 4,495,699 | A | * | 1/1985 | Oakes | 30/360 |
| 4,635,437 | A | | 1/1987 | Parton | |
| 4,724,616 | A | | 2/1988 | Adleman | |
| 4,899,447 | A | | 2/1990 | Adleman | |
| 5,048,190 | A | | 9/1991 | Aurness et al. | |
| 6,116,133 | A | * | 9/2000 | Nishida | 83/686 |
| 6,266,886 | B1 | | 7/2001 | Tandart | |
| 2002/0066897 | A1 | * | 6/2002 | Meis et al. | 256/65.1 |

* cited by examiner

*Primary Examiner*—Joseph J Hail, III
*Assistant Examiner*—Jamal Daniel
(74) *Attorney, Agent, or Firm*—Polster, Lieder, Woodruff & Lucchesi, L.C.

(57) ABSTRACT

This fence post tool makes an opening in a fence post to receive a fence rail. The tool includes a threaded first member received within the hollow fence post and having an elongate handle to manipulate the first member into position adjacent a predrilled pilot hole. A second member includes a cutting edge defining the profile of the cutout and having a bolt received through the second member and into the threaded passage of the first member to draw the second member cutting edge into cutting engagement with the fence post sidewall.

4 Claims, 3 Drawing Sheets

FENCE POST TOOL

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates generally to a fence post tool and more particularly to a tool for cutting an opening in a hollow fence post sidewall to receive a fence rail.

The general idea of cutting an opening in a flat plate-like object to afford access is not in itself new and has been used in building construction in paneling, for example, in U.S. Pat. No. 4,087,913.

However, in fence posts there is a problem of accessing the area where the opening is to be made and providing an accurate locator for the cutout is difficult, time consuming and can be frustrating where accuracy is required to avoid a wrong cutout being made.

The present tool facilitates making such cutout in a manner not revealed by the known prior art.

SUMMARY OF THE INVENTION

The present fence post cutout tool overcomes the disadvantages of previously known systems for providing a cutout in a panel for access purposes.

The system is not limited to fence construction but is particularly effective as a means for cutting an opening in a fence post in a cost effective and simplified manner which facilitates the fitting of a fence rail to the fence post and provides effective means of locating the cutting edge of the tool by providing a pilot hole and a means for lining up the pilot hole with the tool within the hollow post.

This fence post tool is for making a rail-receiving opening in a hollow fence post, and comprises a first member received within the fence post and including a threaded passage; a second member having a cutting edge defining a cutout in the fence post, a bolt is received through the second member and into the threaded passage of the first member to draw the cutting edge of the second member into cutting engagement with the fence post.

It is an aspect of this invention to provide an elongate handle attached to the first member to position said first member in the proximity of the pilot hole in the fence post. The handle is preferably longer than the fence post into which it fits.

It is a further aspect of this invention to provide that the first member includes two interconnected parts having biasing spring means between them to be overcome before the two parts can be introduced into the fence post. The two parts of the first member are held apart by an adjustable threaded connection.

It is another aspect of the invention that the second member includes a guide stem and the first member includes a guide opening receiving the guide stem in sliding relation, there being alignment means provided between the guide stem and the guide opening.

It is still another aspect of the invention that the first member includes a chamber receiving the cutting edge and the cutout portion and another aspect to provide that the cutting edge is shaped to suit the rail profile.

This fence post tool is relatively simple to manufacture and install and is most effective for its intended purpose.

DESCRIPTION OF THE PREFERRED EMBODIMENT

Figure 1:
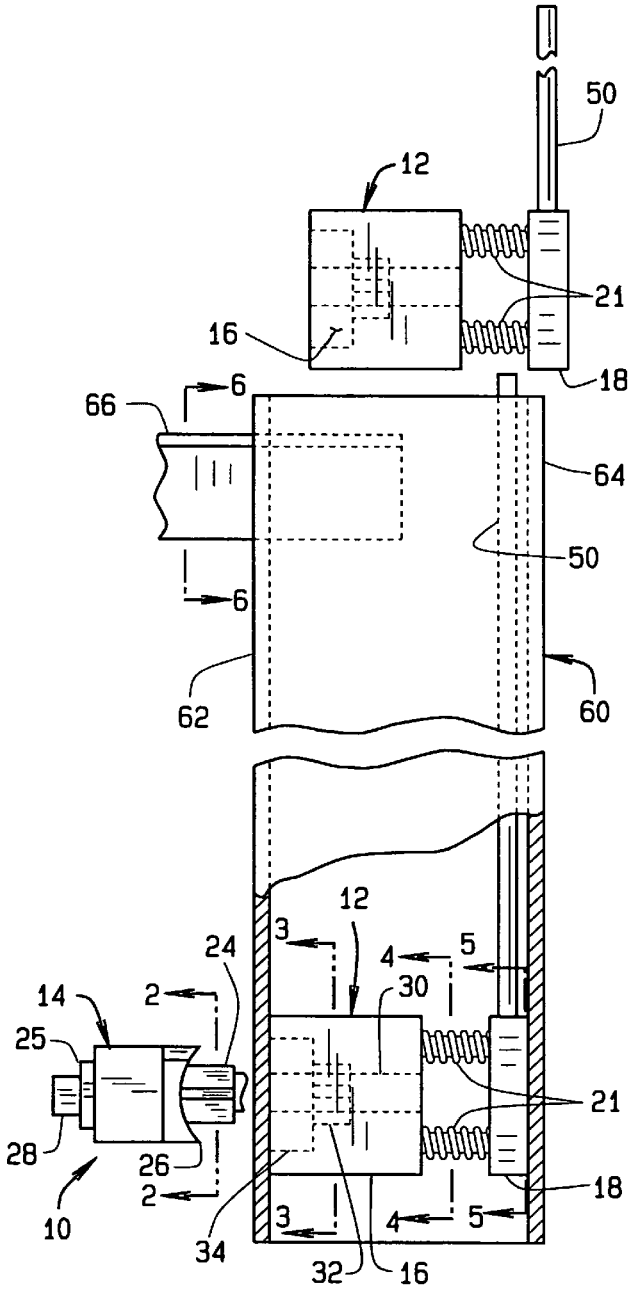
FIG. 1 is a longitudinal sectional view showing the incipient entry of a first member into the hollow post adjacent a pilot hole.
Figure 2:
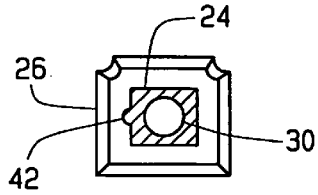
FIG. 2 is a cross-sectional view taken on line 2-2 of FIG. 1.
Figure 3:
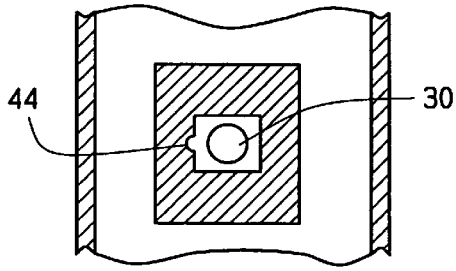
FIG. 3 is a cross-sectional view taken on line 3-3 of FIG. 1.
Figure 4:
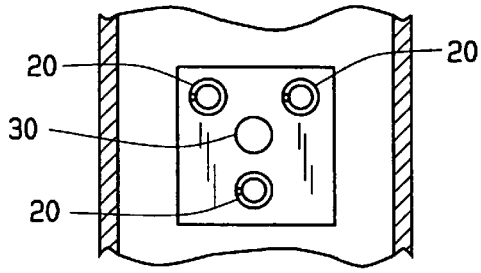
FIG. 4 is a cross-sectional view taken on line 4-4 of FIG. 1.
Figure 5:
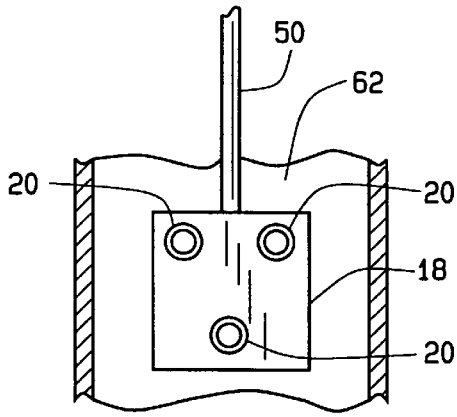
FIG. 5 is a cross-sectional view taken on line 5-5 of FIG. 1.

Referring now by reference numerals to the drawings and first to FIGS. 1-5 it will be understood that the fence post tool 10 shown in FIG. 1 is a two-part device.

Figure 7:
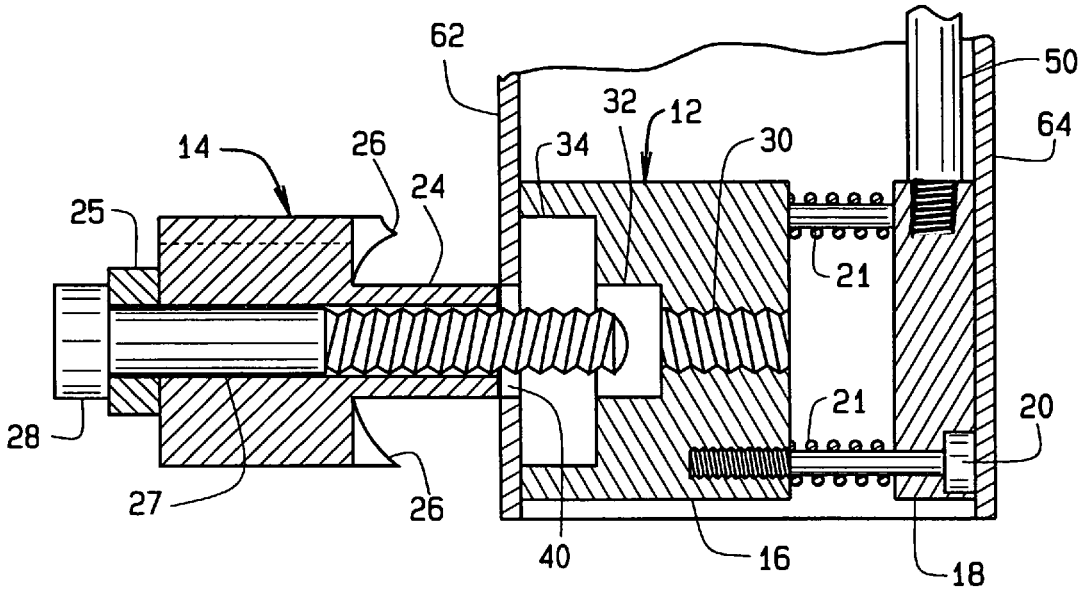
FIG. 7 is an enlarged cross-section showing the arrangement of parts prior to the cutting process.
Figure 6:
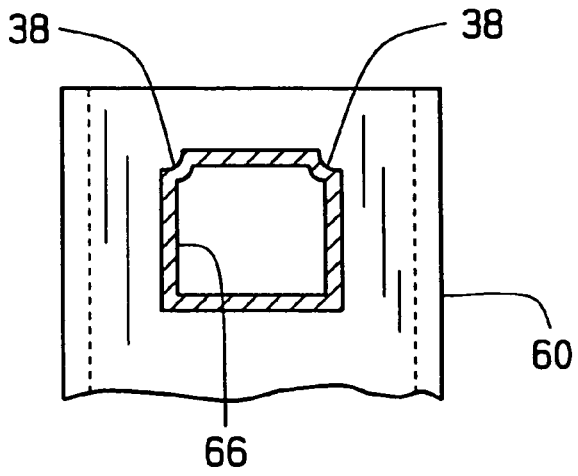
FIG. 6 is a cross-sectional view taken on line 6-6 of FIG. 1.

In essence, the tool 10 consists of a first member 12 received within a hollow fence post 60 and a second member 14 cooperating with the first member to perform the cutting operation as best shown in FIGS. 6 and 7.

The first member 12 is in two parts 16 and 18 connected by a plurality of spring-loaded bolts 20, biased outwardly by springs 21, three in number in the embodiment shown, and having an overall width which is initially greater than the width between the sidewalls 62 and 64 of the fence post 60. This necessitates that the two parts must be squeezed together, as by tightening the bolts 20, so that when the two parts are within the fence post 60 they are expanded to exert at least a light pressure on said sidewalls 62 and 64. When under light pressure the two parts 16 and 18 can be pushed into the fence post 60 until they are in the proximity of a pilot hole 40 locating the lower of the two rails 66. The two parts can be manipulated by the handle 50 until the pilot hole 40 is lined up with the threaded passage 30. In the embodiment shown, the handle 50 is threadedly attached to the part 18 of the first member 12.

The second member 14 includes a generally square, reduced size stem 24, and a cutting edge 26 and has a bolt 28 passing therethrough. The first member 12 has a threaded passage 30 receiving the bolt 28, a socket 32 receiving the stem 24 and another socket 34 receiving the cutting edge 26 and the cutout portion 36 of the post sidewall as best shown in FIG. 7.

Referring now specifically to FIG. 6 and FIG. 7 it will be noted that the pilot hole 40 is drilled in the sidewall 62 to receive the bolt 28 and the stem 24. When the bolt 28 is received within the threaded passage 30 sufficiently to obtain purchase further rotation of the bolt 28 will cause the cutting edge 26 to be drawn into engagement with the relatively soft metal of the fence post sidewall 62 and form the cutout 36 conforming to the profile of the cutting edge 26. As the bolt 28 is rotated the relatively hard metal cutting edge 26 cuts into the soft metal of the fence post sidewall 62 resulting in a separation of the cutout 36 from the sidewall 62. In the embodiment shown, the cutting edge 26 and the member 12 as a whole may be manufactured from hardened steel while the fence post maybe manufactured from relatively soft material such as aluminum or plastic. One or more washers 25 are provided to facilitate turning the bolt 28.

In the preferred embodiment the substantially square stem 24 slides easily into the socket 32 accommodating it and, in order to provide alignment, the stem 24 includes a bead 42 and the socket 32 includes a matching groove 44, the bead and groove providing a means of aligning the parts.

It is thought that the tool has been sufficiently understood from the foregoing description of parts but for completeness of disclosure the use of the tool will be briefly summarized.

The tool 10 is initially disposed in the position shown in FIG. 1. The two connected parts 16 and 18 which form the first member 12 are compressed to permit the assembly to be lowered or pushed into the hollow fence post 60 for example into the vicinity of the lower rail location by means of the handle 50 until they are aligned with the predrilled circular pilot hole 40. This pilot hole is large enough to allow entry of the second member stem 24 and the bolt 28.

It is a relatively simple matter to visually align the pilot hole 40 with the threaded passage 30 and rotate the bolt 28 into the threaded passage 30 to draw the cutting edge 26 into the sidewall 62 until the cutout portion 36 is delivered into the socket chamber 34.

At this point the bolt 28 can be counter-rotated until the tool is disengaged from the fence post 60 thereby allowing the member 12 to be withdrawn from the fence post.

Figure 8:
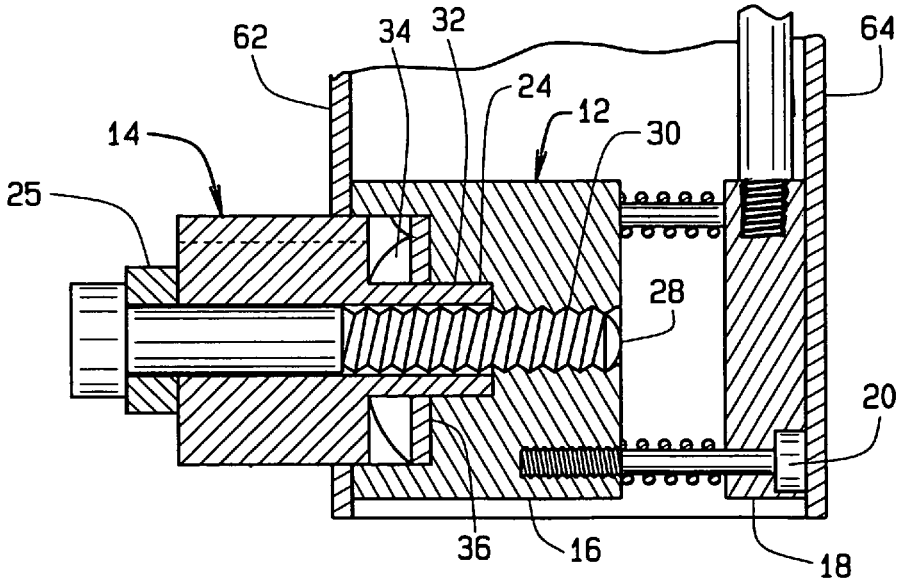
FIG. 8 is an enlarged cross-section showing the arrangement of parts following the cutting process.
Figure 9:
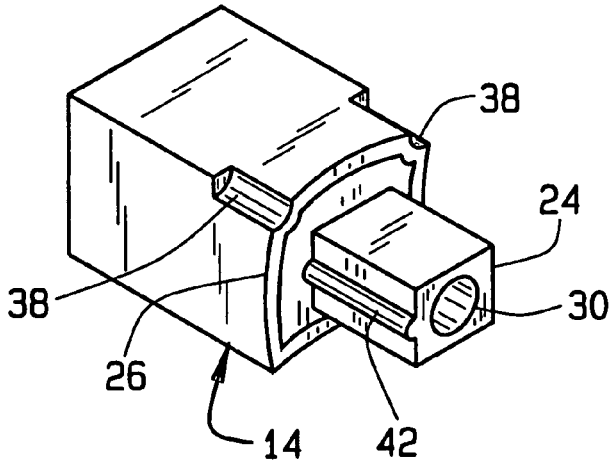
FIG. 9 is an isometric view showing the cutting edge and the stem.

It will be understood from FIG. 9 that the cutting edge 26 is curved to facilitate the cutting action. Also as shown in FIG. 8 the cutting edge 26 may be shaped to suit fluted edges 38 as an ornamental or orientation feature.

Although the invention has been described by making detailed reference to a single preferred embodiment, such detail is to be understood in an instructive, rather than in any restrictive sense many variations being possible within the scope of the claims hereunto appended.

We claim as our invention:

1. A fence post tool making a rail receiving opening in a hollow fence post, the tool comprising:

a) a first member received within the fence post and including a threaded passage;

b) a second member having a cutting edge defining a cutout in the fence post;

c) a bolt received through the second member and into the threaded passage of the first member to draw the cutting edge of the second member into cutting engagement with the fence post; and d) an elongate handle attached to said tool to permit said tool to be lowered into the fence post to position said tool within the post in the proximity of a pilot hole;

e) the first member including two interconnected parts having biasing spring means between them squeezable together so that they can be introduced into the fence post.

2. A fence post tool as defined in claim 1 wherein the two parts are held apart by an adjustable threaded connection.

3. A fence post tool for making a rail receiving opening in a hollow fence post, the tool comprising:

a) a first member having two parts connected by a plurality of bolts each having a spring and extending between the two parts such that the overall length of the combined parts is greater than the overall size of the hollow fence post whereby when the springs are compressed to a size small enough for the first member to be received within the fence post the two pieces are under compression within the fence post.

b) the second member includes a guide stem and a cutting edge and the first member includes a guide socket receiving the stem in sliding relation and the first member includes a socket receiving the cutting edge and the cutout portion; and c) a bolt is received through the second member and into a threaded passage of the first member thereby drawing the cutting edge into cutting engagement with the fence post.

4. A fence post tool as defined in claim 3 wherein an elongate handle is attached to said tool to permit said tool to be lowered into the fence post to position said tool in the proximity of a pilot hole.

* * * * *

UNITED STATES PATENT AND TRADEMARK OFFICE

CERTIFICATE OF CORRECTION

PATENT NO. : 7,802,367 B1
APPLICATION NO. : 11/406708
DATED : September 28, 2010
INVENTOR(S) : Roger Hoeckelmann and Steve Vogelgesang It is certified that error appears in the above-identified patent and that said Letters Patent is hereby corrected as shown below:

Title Page Under (12)
Replace "Hocckelmann et al."
with --Hoeckelmann et al.--

Title page item (76)
Replace "Hocckelmann"
with --Hoeckelmann--

Signed and Sealed this

Thirtieth Day of November, 2010

David J. Kappos

David J. Kappos
*Director of the United States Patent and Trademark Office*